US007482597B2

(12) United States Patent
Grassauer et al.

(10) Patent No.: US 7,482,597 B2
(45) Date of Patent: Jan. 27, 2009

(54) METHOD AND DEVICE FOR GENERATING ALFVÉN WAVES

(75) Inventors: Andreas Grassauer, Vienna (AT); Manfred Hettmer, Vienna (AT); Norbert Frischauf, Zwölfaxing (AT); Tobias Bartusch, Neusäass (DE)

(73) Assignee: Qasar Technologieentwicklung (AT)

( * ) Notice: Subject to any disclaimer, the term of this patent is extended or adjusted under 35 U.S.C. 154(b) by 492 days.

(21) Appl. No.: 10/572,042

(22) PCT Filed: Sep. 15, 2004

(86) PCT No.: PCT/AT2004/000313

§ 371 (c)(1),
(2), (4) Date: Mar. 15, 2006

(87) PCT Pub. No.: WO2005/027142

PCT Pub. Date: Mar. 24, 2005

(65) Prior Publication Data

US 2006/0289117 A1 Dec. 28, 2006

(30) Foreign Application Priority Data

Sep. 15, 2003 (AT) ..... A 1448/2003

(51) Int. Cl.
*H01J 49/26* (2006.01)

(52) U.S. Cl. ..... 250/396 ML; 250/281; 250/423 P

(58) Field of Classification Search ..... 250/281, 250/396 ML, 423 P; 376/106, 123
See application file for complete search history.

(56) References Cited

U.S. PATENT DOCUMENTS

| | | | | | |
|---|---|---|---|---|---|
| 4,263,097 | A | * | 4/1981 | Ohkawa | 376/123 |
| 4,267,488 | A | * | 5/1981 | Wells | 376/107 |
| 4,412,967 | A | * | 11/1983 | Winterberg | 376/106 |
| 4,458,148 | A | * | 7/1984 | Hirshfield et al. | 250/284 |
| 5,003,225 | A | * | 3/1991 | Dandl | 315/111.41 |
| 5,300,861 | A | * | 4/1994 | Helgesen et al. | 315/111.41 |
| RE34,806 | E | * | 12/1994 | Cann | 427/446 |

(Continued)

OTHER PUBLICATIONS

Hanna J et al, "Alfven wave propagation in a helicon plasma" Physics of Plasmas AIP USA vol. 8, No. 9, Sep. 2001, pp. 4251-4252, XP008039102.

(Continued)

*Primary Examiner*—David A. Vanore
*Assistant Examiner*—Johnnie L Smith, II
(74) *Attorney, Agent, or Firm*—Brooks Kushman P.C.

(57) ABSTRACT

The invention relates to a method and a device for generating Alfvén waves, in which ionizable material is provided that penetrates a magnetic field. In order to create such a method or a device in which material can be conveyed based on the Alfvén waves, the magnetic field consists of a primary magnetic field that is periodically deformed by at least one oscillating secondary magnetic field that is polarized in the opposite direction from the primary field such that Alfvén waves are created in the ionizable material located in said magnetic field. The Alfvén waves propagate at a speed that depends on the density of the material penetrating the magnetic field and the field intensity of the magnetic field. The field intensity of the magnetic field is greater than the kinetic energy of the material located in the magnetic field such that material is conveyed by means of the Alfvén waves.

33 Claims, 9 Drawing Sheets

U.S. PATENT DOCUMENTS

| | | | | |
|---|---|---|---|---|
| 5,449,434 | A * | 9/1995 | Hooke et al. | 216/70 |
| 5,861,752 | A * | 1/1999 | Klick | 324/464 |
| 2003/0234616 | A1 * | 12/2003 | Dandl | 315/111.41 |

OTHER PUBLICATIONS

Scheurwater R: "Plasma acceleration by finite amplitude Alfven wave beams" Astronomy and Astrophysics West Germany vol. 234, No. 1-2, Aug. 1990, pp. 560-566, XP008039152.

"Formation of Alfven waves by simultaneous imposition of a high magnetic field and an alternating electric current" Current Advances in Materials and Processes—Zairyo To Purosesu, Tokyo, Japan vol. 13, No. 1, 2000, p. 152, XP009007907.

Kletzing C A: "Electron acceleration by kinetic Alfven waves" Journal of Geophysical Research USA vol. 99, No. A6, Jun. 1, 1994, pp. 11095-11103, XP008039158.

Yagai T et al: "Excitation of an axisymmetric shear alfvin wave by a Rogowski-type antenna" AIP Conference Proceedings AIP USA No. 669, Aug. 2003, pp. 137-140, XP002307106.

* cited by examiner

METHOD AND DEVICE FOR GENERATING ALFVÉN WAVES

The invention relates to a method for the generation of Alfvén waves, with material which can be ionized being produced, which passes through a magnetic field.

The invention also relates to a device for the generation of Alfvén waves, having a device for production of material which can be ionized, having a magnetic nozzle, which is formed from at least one device for generation of a magnetic primary field and a coil for generation of a magnetic secondary field, and a channel for guiding the material which can be ionized through the magnetic fields, and electrical supply devices.

Finally, the invention relates to a motor for a vehicle using a device as mentioned above for generation of Alfvén waves.

Alfvén waves are magnetohydrodynamic waves which were named after the Swedish Physicist Hannes Olof Gösta Alfvén, for which he was awarded the Nobel Prize for physics in 1970. Alfvén waves are low-frequency waves in electrically conductive liquids or magnetized plasma which are caused by the change in the intensity or geometry of a magnetic field. Alfvén waves propagate at a finite velocity, the so-called Alfvén velocity. An Alfvén wave is the wave propagation of a disturbance in the magnetic field. In a vacuum, an Alfvén wave propagates at the speed of light in a vacuum. When the magnetic field interacts with a material which can be ionized, for example a plasma, the Alfvén velocity is governed by the mass density or charge density of the dielectric medium. Alfvén waves can transport mass, and thus energy and impulse as well, by the interaction of material with the magnetic field. For mass transport such as this, so-called Alfvén limit plays a role, within which the field strength must be greater than the kinetic energy of the material to be transported. The effect of material transport by Alfvén waves was verified for the first time in the atmosphere of exotic stars by spectroscopic means, and later in laboratory experiments.

Alfvén waves are present universally in plasma in space and result from the interaction between magnetic fields and currents flowing in them. Typically, Alfvén waves occur at a low frequency in magnetized conductive media, such as stellar atmospheres. The waves not only transport electromagnetic energy but also include information about the changes in the plasma currents and in the topology of the magnetic field associated with them. Since Hannes Alfvén proposed this principle of electromagnetic transmission in 1942, two concepts have awoken the interest of researchers. The concept of a compression wave, in which the density and field strength vary, and the concept of a shear wave, in which only the direction of the magnetic field is changed. The dynamics of Alfvén shear waves are of particular interest in the polar regions of the Earth, since the Alfvén waves probably play a role in the creation of aurora light. Further details can be found in the publications "The Physics of Alfvén Waves", Neil F. Cramer, Wiley Publishing 2001, ISBN: 3-527-40293-4 and "Aktive Sterne", Klaus G. Strassmeier, Springer Verlag 1997, ISBN: 3-211-83005.

So far, Alfvén waves have been used only for methods relating to use in fusion reactors. By way of example, U.S. Pat. No. 4,661,304 discloses the generation of Alfvén waves with the aid of a resonant coil mechanism in order to generate super resonant cyclotron frequencies in a fusion reactor. A similar design based on a plurality of coils arranged in a circular shape in order to achieve high temperatures in a fusion reactor is described in Russian Patent Specification SU 1 485 436. In the applications so far, the energy has been transported by means of Alfvén waves. Direct use of mass transport by means of Alfvén waves has not occurred in this case (see also H. Alfvén, "Spacecraft Propulsion: New Methods", _Science_, Vol. 176, pages 167-168, Apr. 14, 1972).

The use of Alfvén waves for propulsion of vehicles, in particular spacecraft, has not yet been proposed. Two principles are currently being used as electrical reaction propulsion for vehicles, in particular spacecraft, but their usefulness is restricted owing to the relatively high power required because of the mass of external energy sources. The energy contained in the fuel in chemical propulsion systems must be supplied from an external energy source in the case of electrical propulsion systems. Furthermore, electromagnetic propulsion systems are used despite the high mass of the electrical energy storage medium. In the case of electrical propulsion systems, the ion component of a gas which is excited in various ways is accelerated by means of electrical fields. Because of the physical separation between the electrodes by which the acceleration path is defined, multiplied by the cross section of the emission beam, only low thrust densities are possible with acceptable energy potential differences, and this governs the efficiency. Since only positively charged ions are emitted in this case and are subsequently neutralized downstream from the motor by means of an external electron source in order to prevent static potential, these are referred to as ion motors.

In the case of magnetic propulsion systems, in contrast, the magnetic field is used only as a static nozzle with hot walls. Particles that are bound in the field interact with one another on the basis of their Larmor frequency. The falling gradient of the field strength, which results from the grading, likewise results in binding forces which become smaller, as a result of which the particles are inelastically scattered from the bonding to the field after n-th order impacts, and are pressed out of the field, which is in the form of a nozzle, by the thermodynamic pressure.

In general, the plasma to be expanded from the field is thermally excited by means of an arc. The difference from pure arc motors is mainly that the plasma temperature is not restricted by the thermal load capacity of the nozzle walls. The additional interaction of the plasma with the generally static field forces is in this case of secondary importance. Owing to the dynamics of a thermally excited plasma in a magnetic field, plasma motors are thus also referred to as magnetoplasmadynamic proportion systems or MPD motors. Traditional MPD motors can be subdivided into two groups, specifically into self-induced field and externally-induced field motors. In the case of self-induced field motors, the field of the magnetic nozzle is induced by the high discharge current of the arc, that is to say there is a magnet but no coil. In the case of externally-induced field motors, all of the discharge current is used for heating, since the field of the magnetic nozzle produced by a coil is in fact formed by an external field.

A magnetic plasma motor is known, for example, from U.S. Pat. No. 6,334,302B1, and is known by the title VASIMR (Variable Specific Impulse Magnetoplasma Rocket). In this case, a plasma generator is used to pass a plasma through at least two magnetic toroidal coils, and is thermally excited in this magnetic field. The radio-frequency field oscillation heats the plasma in a type of magnetic bottle by means of magnetic field oscillations. The geometry of the variable-strength magnetic field fundamentally remains unchanged, for which reason the magnetic field is used for energy transport, but not for material transport. It has been possible to achieve better efficiencies with this motor than in the case of traditional magnetoplasmadynamic propulsion systems.

U.S. Pat. No. 4,412,967A describes a particle accelerator using the principle of Alfvén waves. A particle beam such as this can be used as a drilling tool or weapon.

The present invention is based on the object of providing a method and a device for the generation of Alfvén waves, by means of which mass is transported. The aim is to be able to use the method and the device as a motor for vehicles, in particular spacecraft.

With regard to the method, the object according to the invention is achieved in that the magnetic field comprises a magnetic primary field which is deformed periodically by at least one oscillating magnetic secondary field of the opposite polarity to the primary field, as a result of which Alfvén waves are formed in the material which can be ionized and is located in this magnetic field, which Alfvén waves propagate at a velocity which depends on the mass density of the material passing through the magnetic field and on the field strength of the magnetic field, with the field strength of the magnetic field being greater than the kinetic energy of the material which is located in the magnetic field, so that mass is transported by the Alfvén waves. The method according to the invention for the first time makes use of Alfvén waves for transport of mass. A material beam that is generated in this way makes it possible to produce propulsion systems for vehicles, in particular spacecraft, such as space satellites, for example by use of the reaction principle. However, a range of other applications are also possible, some of which will be mentioned briefly further below.

In order to allow mass transport by means of Alfvén waves, specific preconditions have to be satisfied, which are described further below. The Alfvén waves are caused by periodic changes in the field geometry of a magnetic primary field. This periodic change in the geometry of the primary field is caused by at least one second, periodically varying magnetic field of opposite polarity, which is referred to in the following text as the secondary field, and is caused by a secondary coil. The oscillating secondary field is generated by supplying an oscillating signal to the secondary coil. The frequency and the form of the drive signal for the secondary coil depend on the nature of the application and on the specific characteristics of the field coils being used. Fundamentally, at relatively high secondary field oscillation frequencies, an area is entered where the operating paths become shorter since the full deformation paths of the magnetic field can no longer be used for mass transport. The superimposition of the magnetic fields results in the lines of force of the primary field being forced outwards on the side opposite the secondary coil, thus creating a funnel-shaped primary field. This field funnel leads to a reduction in the volume enclosed by the magnetic field. The material which can be ionized and is located in the magnetic field is thus compressed, and is forced out of the field. The material which interacts with the magnetic field is subdivided on the one hand into the emission mass and, to a smaller extent, into Lorentz particles. The Lorentz particles are located in the area of relatively high flux densities, and are bound to the lines of force. In contrast, the remaining particles are not bound to the lines of force and can thus be referred to as quasi-free particles. The quasi-free particles are scattered on the Lorentz particles. For this reason, the forces which are caused by the Lorentz particles and which act on the enclosed material can also be referred to as wall forces. In contrast to additional magnetoplasmadynamic motors, the magnetic wall forces not only carry out the function of a nozzle but, by virtue of their dynamics, are also responsible for the compression of the emission mass. In order to allow mass transport by means of the Alfvén waves at all, the so-called Alfvén limit within which the magnetic field strength must be greater than the kinetic energy of the interacting particles must thus be taken into account. If this condition is not satisfied, the Alfvén waves cannot be used to transport mass. The variables in the plasma space must be analyzed for this condition. If the kinetic energy of the particle is greater than the magnetic field, then the particles are not bound to the magnetic field, and thus cannot follow it. If the particles are, however, bound in the magnetic field in accordance with the above definition, as is defined by the Alfvén limit, the particles are transported by the magnetic field. The mathematical principles relating to this will be explained in more detail later.

The magnetic field is deformed with the propagation velocity of the Alfvén waves, the so-called Alfvén velocity. In this case, a distinction is drawn between two options.

According to one feature of the invention, the Alfvén velocity is less than or equal to the speed of sound in the material which is located in the magnetic field. This represents the case of elastic compression of the enclosed medium. In the case of this elastic compression, no heating of the medium occurs, other than unavoidable friction losses, and, instead of this, an internal mechanical overpressure is created with respect to the ambient pressure. In the case of an Alfvén velocity which is less than or equal to the speed of sound of the material which is located in the magnetic field, the kinetic impulse is thus largely transmitted elastically. In the case of such elastic acceleration of the emission mass, it is not possible to achieve particularly high outlet velocities since the internal speed of sound is not exceeded at the outlet temperature of the medium to be transported. Use of this method is feasible primarily for operation with conductive liquids, since the high density of the material associated with such liquid in conjunction with a possibly small proportion of ions does not allow high Alfvén velocities in any case.

If the Alfvén velocity at which the Alfvén waves propagate is greater than the speed of sound of the material which is located in the magnetic field, this material is compressed inelastically, and is thus heated. The magnitude of the elastically transportable impulse is governed by the respective modulus of elasticity and, associated with this, by the speed of sound. The inelastic component of the impulse which is transported by means of the Alfvén waves and the Lorentz particles is converted to incoherent internal movement, that is to say to heat. The material which has been thermally excited in this way therefore not only assumes a higher temperature but also has a higher speed of sound, at which it expands from the field funnel of the magnetic nozzle. Heating therefore takes place directly via the field forces, which are in the form of a magnetic nozzle, without any external heating mechanism. In the case of inelastic compression, the ratio between the compression time and the energy losses resulting from radiated emission caused by the heating is important. In an optimized system, the propagation time of the Alfvén waves, which depends on the operating path and on the Alfvén velocity, should be matched such that less energy is radiated than is supplied by the pulse during the time period. Thermal excitation by means of inelastic compression of the emission mass can be used for applications in a hard vacuum, since a small mass density is required to achieve high Alfvén velocities for this purpose. Despite short acceleration distances, high impulses can be supplied in this case by means of a high Alfvén velocity.

According to one feature of the invention, the magnetic primary field is essentially constant. This is achieved by means of an essentially constant supply to one coil in order to produce the primary magnetic field, so that the circuitry complexity level is low. The constant magnetic primary field can likewise be generated by means of permanent magnets.

If, in the case of the generation of the primary magnetic field using a coil, the so-called primary coil, the magnetic primary field is switched off periodically, the thermal heating caused by the electrical resistance of the primary coil can be reduced. In this case, the frequency and time for which it is switched off must be appropriately chosen in order to ensure that the thermal energy can be dissipated within the phases during which it is switched off.

It is not expedient to maintain the magnetic secondary field during the time in which the primary field is switched off, so that the magnetic secondary field is preferably likewise switched off during the periods in which the primary field is switched off. The primary field is switched off, and if appropriate the secondary field as well, by means of an appropriate control device, which are connected to the supply devices for the coils for generation of the primary field and of the secondary field.

According to a further feature of the invention, the magnetic field is focused in the axial and/or radial direction in order to improve the effect of the magnetic nozzle. Various methods can be used for focusing, for example magnetic methods, or else specific arrangements and mechanical configurations of the field coils.

The field strength of the magnetic primary field can be varied while the magnetic secondary field is switched on, in order to influence the deformation of the primary field. In this case, the primary field is varied only to a minor extent. The geometry of the mutually deformed fields can be influenced, and thus optimized, by this temporary reduction or increase in the primary field.

A further feature of the invention provides for the Alfvén waves to be phase-delayed. This phase delay which can be achieved, for example, by means of a delayed voltage rise while the secondary coil is being switched on, can be used to lengthen the time period of the deformation phase of the primary field. Influencing the Alfvén waves in this way is worthwhile when the Alfvén velocity is too high. By way of example, it may be advantageous to slow down the field deformation in this way for a hydrodynamic application of the method according to the invention. This makes it possible to achieve variations in the sound field or efficiency optimizations. Alternatively, when using the method in the presence of a plasma source, a reduction in the Alfvén velocity may be advantageous when, for example, the losses resulting from black-body radiation excessively restrict the efficiency, for example because the compression temperature is too high.

If the Alfvén waves generate a thrust on the basis of the reaction principle, the method for generation of Alfvén waves can be used to propel vehicles, in particular spacecraft. In this case, any desired ionization mechanism which carries out the ionization of a gas that is located in a container is used as the plasma source. The Alfvén waves reduce the volume of the medium flowing in from the plasma source more quickly, and in an oscillating manner, than the medium can expand out of the funnel-shaped magnetic field. The high impulse which is supplied during the brief pulse duration of the magnetic field heats the plasma, thus leading to a higher speed of sound and thus a higher expansion velocity of the plasma. The Alfvén waves can also be used to provide additional acceleration for a plasma beam which has already been accelerated by some other mechanism. Applications of motors such as these extend from attitude control of satellites to propulsion systems for rockets for space missions, and much more. Since the present method can be applied to any desired ions or plasma sources, it is thus also possible to use any desired radio-frequency sources which have no discharge path and therefore have no electrodes that are subject to corrosion. This results in corrosion-free electromagnetic propulsion systems, which have a longer life.

It is likewise possible for the Alfvén waves to generate a particle beam of high kinetic energy which, for example, can be used in the military field, for example in order to render satellites inoperative. In this case, the particle beam of high energy is advantageously generated by means of a single pulse of the secondary coil, while the magnetic primary field is activated.

As already mentioned above, the Alfvén waves can supply additional impulses to an accelerated mass. Any desired accelerated medium can be accelerated again with the aid of the present method, in the form of the afterburner principle. By way of example, the device could be combined with an arc motor, with the material that has been accelerated in this way being additionally accelerated.

It is also possible for phonons to be generated or amplified in the material which is located in the magnetic field, and/or for phonons to be generated or amplified in a surrounding medium by means of the material which is located in the magnetic field. Phonons are amplified by influencing the sound field within the material surrounded by the magnetic field by the influence of the Alfvén waves. Applications in which material which has already been excited by some other mechanism is intended to be provided with an additional impulse, for example in the case of chemical combustion or heating, may be cited as fields of use for the amplification of phonons.

Finally, it is also possible to compress the material which is located in the magnetic field and thus to thermally excite it, and to generate or to amplify electromagnetic radiation by means of the thermal excitation.

Finally, the present method can also be used for surface processing or coating by directing material which can be ionized onto a surface with a high penetration depth, for lithographic purposes. Finally, it is also possible to use the present method to accelerate particles for the purpose of doping semiconductor materials. In principle, a printer operating on the basis of the described method can also be constructed, in which the substance to be applied to a printed copy is accelerated by means of the present method.

The present method would also allow sea water to be desalinated more quickly and more efficiently, since the salt ions could accumulate externally on the lines of force in the magnetic nozzle, and could easily be dissipated.

Finally, the present method could also be used to neutralize the electrical potential around a spacecraft.

Furthermore, the fluctuating magnetic field offers better protection against $\alpha$ and $\beta$ particles, since the magnetic field represents a better braking potential for these particles. Spacecraft which are propelled on the basis of the present method could thus be better protected against high-energy plasma distribution, such as those which occur in the case of solar winds. This means that space flights would no longer have to be governed to such a major extent by the solar cycle and the occurrence of solar winds, since the fluctuating magnetic field also provides additional radiation protection.

The applications mentioned above represent only a few options.

The object according to the invention is also achieved by a device as mentioned above for the generation of Alfvén waves, in which the at least one secondary coil is of the opposite polarity to the device for generation of the primary field, and is supplied with an oscillating electrical signal, as a result of which the magnetic primary field is deformed periodically by the magnetic secondary field, and Alfvén waves are formed in the material which can be ionized and is located in this magnetic field, which Alfvén waves propagate at the Alfvén velocity, with the field strength of the magnetic field being greater than the kinetic energy of the material which is located in the magnetic field, so that mass is transported by the Alfvén waves. The major design features are thus two differently polarized field coils, by means of which the magnetic field, and thus the Alfvén waves, are deformed. Because the Alfvén limit, which has already been mentioned above, is complied with, the Alfvén waves are suitable for transport of mass.

The device for generation of the magnetic primary field may be formed by a coil or else a permanent magnet.

The coils for formation of the magnetic field are advantageously designed to be liquid-cooled. Liquid cooling allows the high operating temperatures to be reduced, thus allowing the mechanical strength to be increased.

A further improvement and a reduction in the electrical resistance of the coils are achieved by using supconducting coils.

The device for production of material which can be ionized can be formed by a container with gas which can be ionized and by an injector device for introduction of the gas which can be ionized into the magnetic field. A plasma generator such as this is particularly suitable for use of the device in space as a propulsion system for spacecraft.

If the device for production of material which can be ionized is formed by a source for supplying electrically conductive liquid, the Alfvén waves can be used to compress this liquid which is located in the magnetic field. This embodiment variant, in which the liquid is used as a flow mass which contains free ions is particularly suitable for use as a hydrodynamic propulsion system, for example for water craft, such as submarines. The advantage in this case is that water can be moved without the propulsion system having any moving parts. Salt water is an ideal medium, because of its relatively good electrical conductivity. Although the Alfvén wave directly influences only the free ions, only a small amount of flow in the emission direction is caused, overall, as a result of the scatter of the remaining particles. Nevertheless, there are also applications for this variant. The high mass density in this case results in only very low Alfvén velocities, for which reason the operating area can be applied to the elastic acceleration of the emission mass. By way of example, the device can be used as a particularly quiet propulsion system which is difficult to locate, for submarines, or as a hydrodynamic pump. Since a pump such as this does not have any moving parts itself, a variant such as this can be used for transportation of liquids when subject to particularly stringent safety requirements. For example, pumps such as these can be used to transport liquids in bioreactors. Since no rotary movement need be transmitted to the container via a bearing, the safety risk of a leak is reduced, and at the same time the cost factor which is normally incurred as a result of the regular replacement of the bearing is avoided. Furthermore, there are no mechanically moving parts which could damage the biomass.

According to a further feature of the invention, a device is provided for phase delaying of the Alfvén waves which are generated. A phase delay such as this can achieve a reduction in the Alfvén velocity, which in some cases may be advantageous.

Finally, devices can be provided for focusing of the magnetic field. These may be in a magnetic form, or else in mechanical form, by means of an appropriate arrangement of the magnet coils.

The focusing device may be formed by the primary coil and, if appropriate, secondary coil with a magnetic core composed of various materials, for example based on an FFAG (Fixed Field Alternating Gradient) core.

Magnetic shielding is advantageously provided to protect sensitive, in particular electronic, assemblies against the relatively strong magnetic fields from the coils. Conventional magnetically permeable shielding materials may be used for this purpose.

If the magnetic shielding includes a shielding plate which is arranged on the side of the magnetic field opposite the outlet direction of the Alfvén waves, this results in additional focusing of the magnetic field.

The deformation of the magnetic fields is controlled by means of a control device which is connected to the electrical supply devices for the coils. A control circuit such as this may be formed by a microprocessor with appropriate interfaces to the supply units for the coils.

In this case, the control device may be formed by a computer, in which case embodiment variants are possible starting from a microcontroller via a microcomputer to a computer unit.

The object according to the invention is also achieved by a motor for a vehicle having a device as mentioned above. If the device is designed to produce material which can be ionized by means of a plasma generator and thrust is generated with the aid of the Alfvén waves on the basis of the reaction principle, suitable motors can be created for vehicles, in particular spacecraft, such as rockets or satellites. The preferred operating area for operation with ionized gas is in the area of inelastic compression of the emission mass. The Alfvén waves reduce the enclosed volume of the medium flowing in from any given plasma source more quickly than this medium can expand out of the funnel-shaped magnetic field. The high impulse which is supplied during the short pulse duration heats the plasma, and this leads to a high speed of sound, and thus expansion velocity, of the plasma. In this case, any desired ionization mechanism can be used as the plasma source, in which case the power which is consumed for this purpose can be restricted to the ionization of the gas. The thermal sink for the primary acceleration mechanism is generated by the Alfvén waves, on the basis of the Carnot principle. Nevertheless, a plasma beam which has been accelerated by some other mechanism can also be provided with additional acceleration by the effect of Alfvén waves. The major advantage is the capability to achieve high outlet velocities, for which reason a plasma motor such as this based on Alfvén waves is particularly suitable for propulsion of spacecraft. In this case, the motors can be used for attitude control of satellites thus increasing the life of modern satellites, which is normally limited by the internal fuel supply, by virtue of the low mass flow of motors such as these. Orbit and attitude control systems are required to compensate for gravitational anomalies, solar wind etc.

In the same way, motors such as these can be used as so-called kick boosters for the propulsion of satellites for transportation to their intended location. A motor such as this with a relatively small fuel consumption allows the total mass to be reduced, or the payload to be increased. The capability to increase the payload makes it possible, for example, to accommodate more transponders in a satellite, thus allowing enormous saving potential or, conversely, greater transponder capacities to be made use of.

The high outlet velocities and low mass flow of motors such as these allow long acceleration phases which are particularly suitable for scientific interplanetary emissions, and can shorten the journey times.

Experimental applications, for example in plasma wind tunnels, for simulation of the interaction of high-speed re-entry bodies into the thin upper layers of planetary atmospheres are also possible. The spectrum of such investigations can be extended by the capabilities to vary a mechanism which is based on Alfvén waves.

If, according to a further feature of the invention, the device for production of material which can be ionized is formed by a device for supplying electrically conductive liquid, the motors can be used as a propulsion system for vehicles in the water, for example for submarines.

If the device for production of material which can be ionized is formed by an arc motor, the material which has already been accelerated by the arc motor can additionally be accelerated on the basis of the afterburner principle.

Other applications, for example for production of plasma beams of high kinetic energy as a weapon or as a pump without any moving parts, are likewise possible.

The present invention will be explained in more detail with reference to the attached drawings, which illustrate schematic diagrams and exemplary embodiments, and in which:

FIG. 1 shows a schematic view of a device for generation of Alfvén waves;

FIGS. 2*a* and 2*b* show two schematic views in order to illustrate the mechanism by which the magnetic fields are deformed;

FIGS. 3*a* to 3*d* show various curves of the current for supplying the secondary coil;

Figure 1:
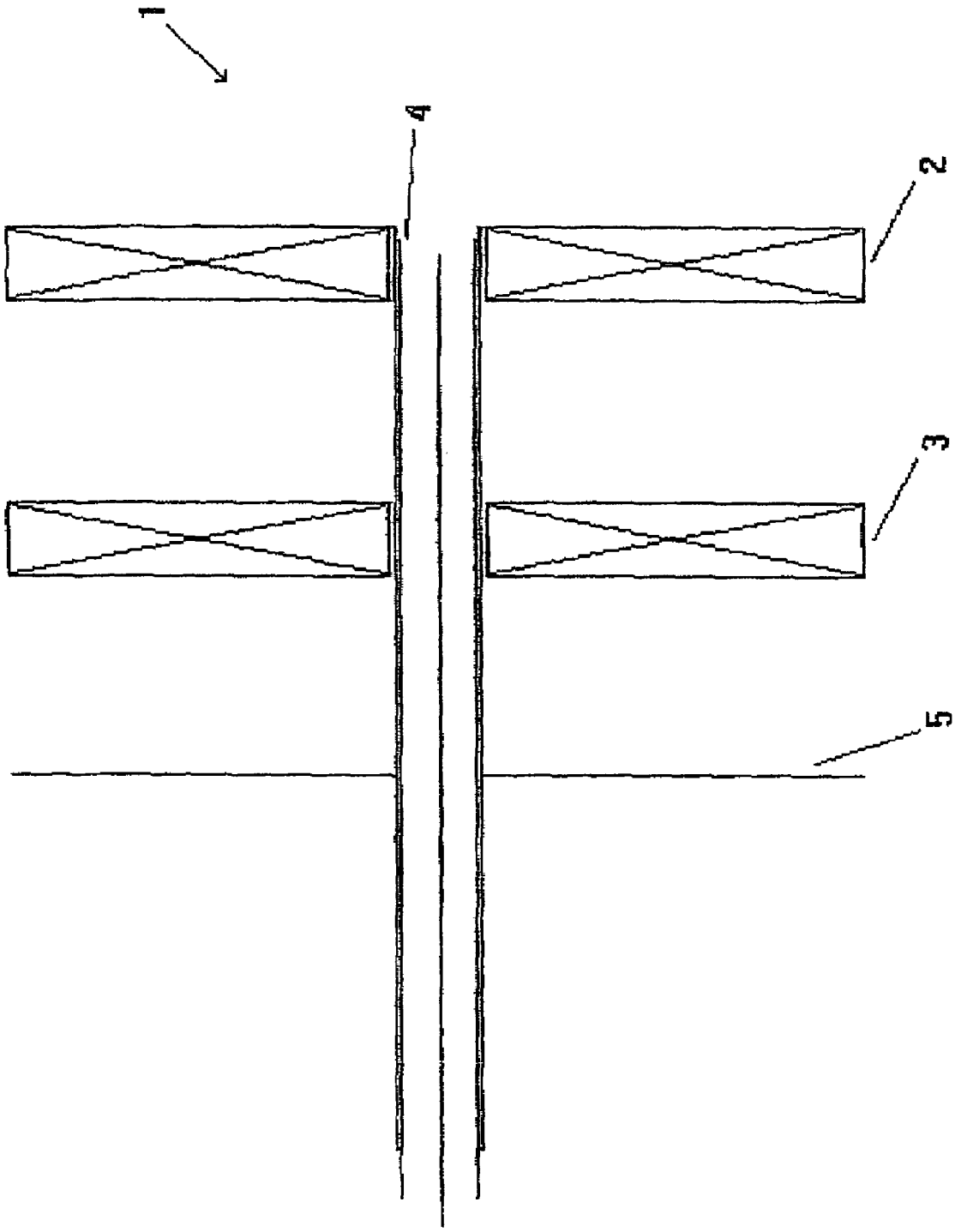

FIG. 1 shows the section through a magnetic nozzle 1 of a device for generation of Alfvén waves, in which a primary coil 2 is provided for generation of a magnetic primary field. At least one secondary coil 3 is located alongside the primary coil 2, is of the opposite polarity to the primary coil 2, and is supplied with an oscillating electrical signal. This results in a magnetic field which is periodically deformed. A tube 4, which ends with the primary coil 2, is passed through the coils 2, 3. A shielding plate 5, which protects the electronics and other components from the magnetic fields of the coils 2, 3, is located at the side, alongside the secondary coil 3, and opposite the primary coil 2. The central tube 4 contains an ionization mechanism, for example based on an electrical discharge. The material which can be ionized is passed into the magnetic field via the tube 4. A liquid which contains free ions can also be used instead of a plasma source. As has already been mentioned further above, the magnetic primary field may also be formed by permanent magnets.

Figure 2A:
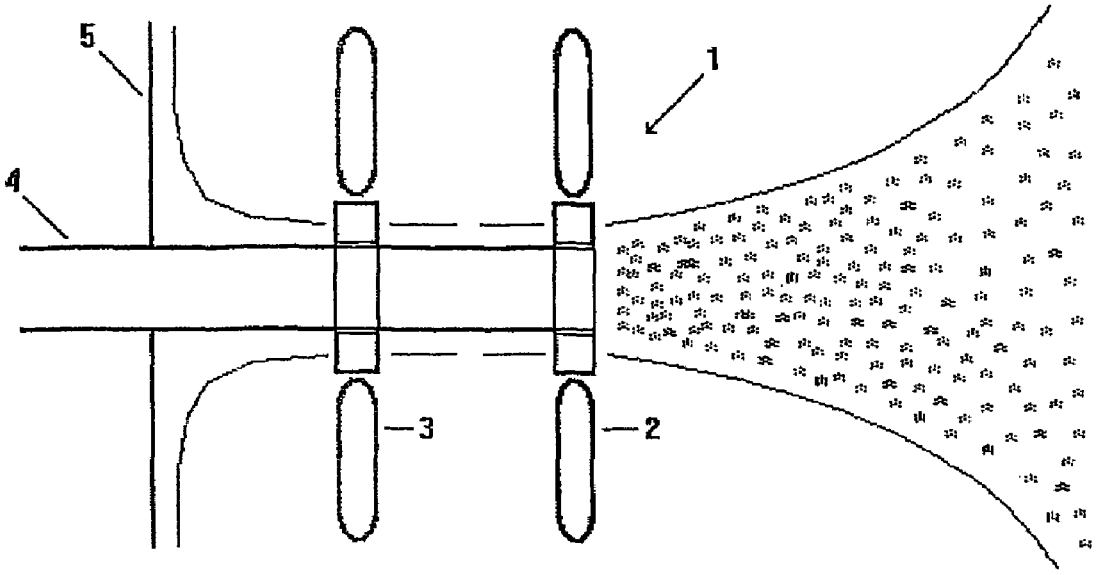
Figure 2B:
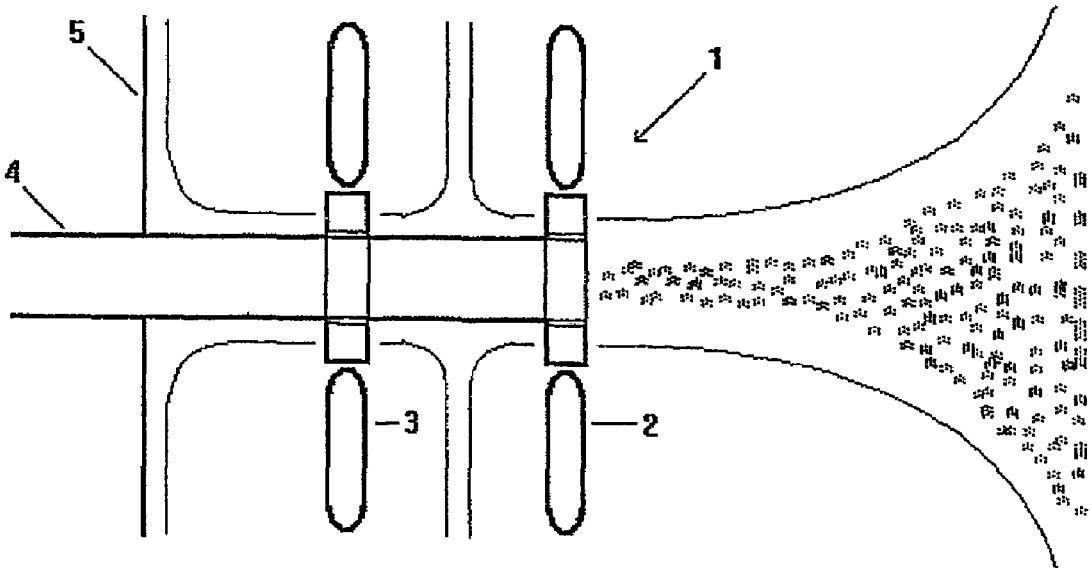

The operating mechanism can be seen better in FIGS. 2*a* and 2*b*, which schematically show the magnetic nozzle 1 in different switching states of the secondary coil 3. In FIG. 2*a*, the secondary coil 3 is switched off, and the primary coil 2 is producing a magnetic field which has a funnel-shaped profile towards the opening of the tube 4, because of the shielding plate 5. The material which is passed through the tube 4 follows this funnel-shaped profile at the opening of the tube 4.

If now, as shown in FIG. 2*b*, the secondary coil 3 is switched on, the magnetic field of the primary coil 2 is deformed, and the lines of force are constricted at the output of the tube 4, thus correspondingly constricting the material transported by the Alfvén waves.

This thus results in an oscillating flow of the ionized material. Mass transport by means of the Alfvén waves is possible when the Alfvén limit is taken into account. For this purpose, the magnetic field strength must be greater than the kinetic energy of the interacting particles. The Alfvén limit thus determines whether the Alfvén waves can transport mass at all.

Furthermore, the effective cross section is the significant factor governing whether the Alfvén waves can compress the emission mass at all. This limit value is in general regarded as not being critical. The compressibility of the enclosed medium depends on the Alfvén velocity as a function of the speed of sound of the enclosed medium.

Figure 3A:
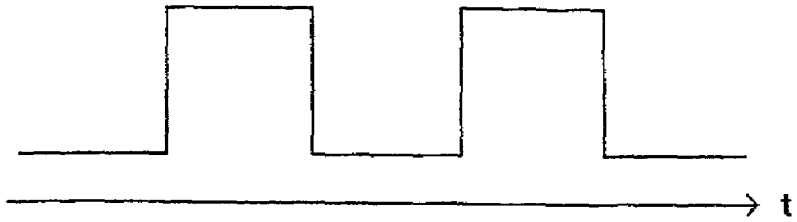
Figure 3B:
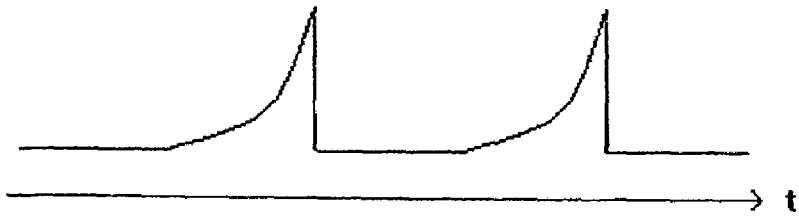
Figure 3C:
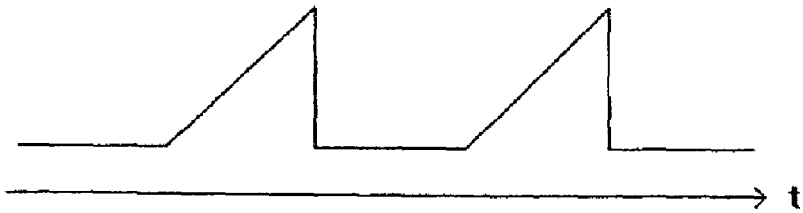
Figure 3D:
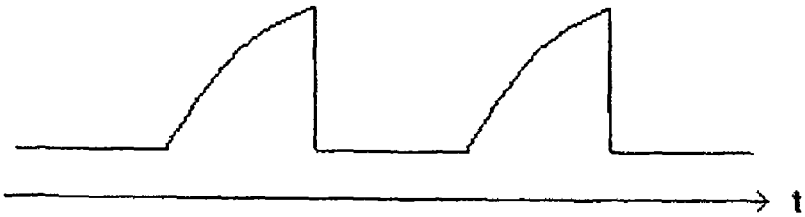

FIGS. 3*a* to 3*d* show various forms of the current for driving the secondary coil 3, and these forms can be matched to the respective applications. In practice, it has been found that a signal form as shown in FIG. 3*a* should advantageously reduce the gradient of the rising flank and, if appropriate, of the falling flank as well. This thus effectively results in a trapezoidal profile of the current for driving the secondary coil 3. This makes it possible to reduce voltage peaks. Furthermore, a sinusoidal alternating current can also be used to drive the secondary coil 3. Improvements can also be achieved by the use of asymmetric drive signals.

Simulations have shown that the present method for generation of Alfvén waves and a device such as this for generation of Alfvén waves can be used to achieve emission velocities and efficiencies which make it possible to efficiently use a propulsion system or a source for plasma beams of high kinetic energy. A propulsion system based on the use of the mass transport of Alfvén waves can thus represent a benefit, in particular in the field of space flight.

Figure 4:
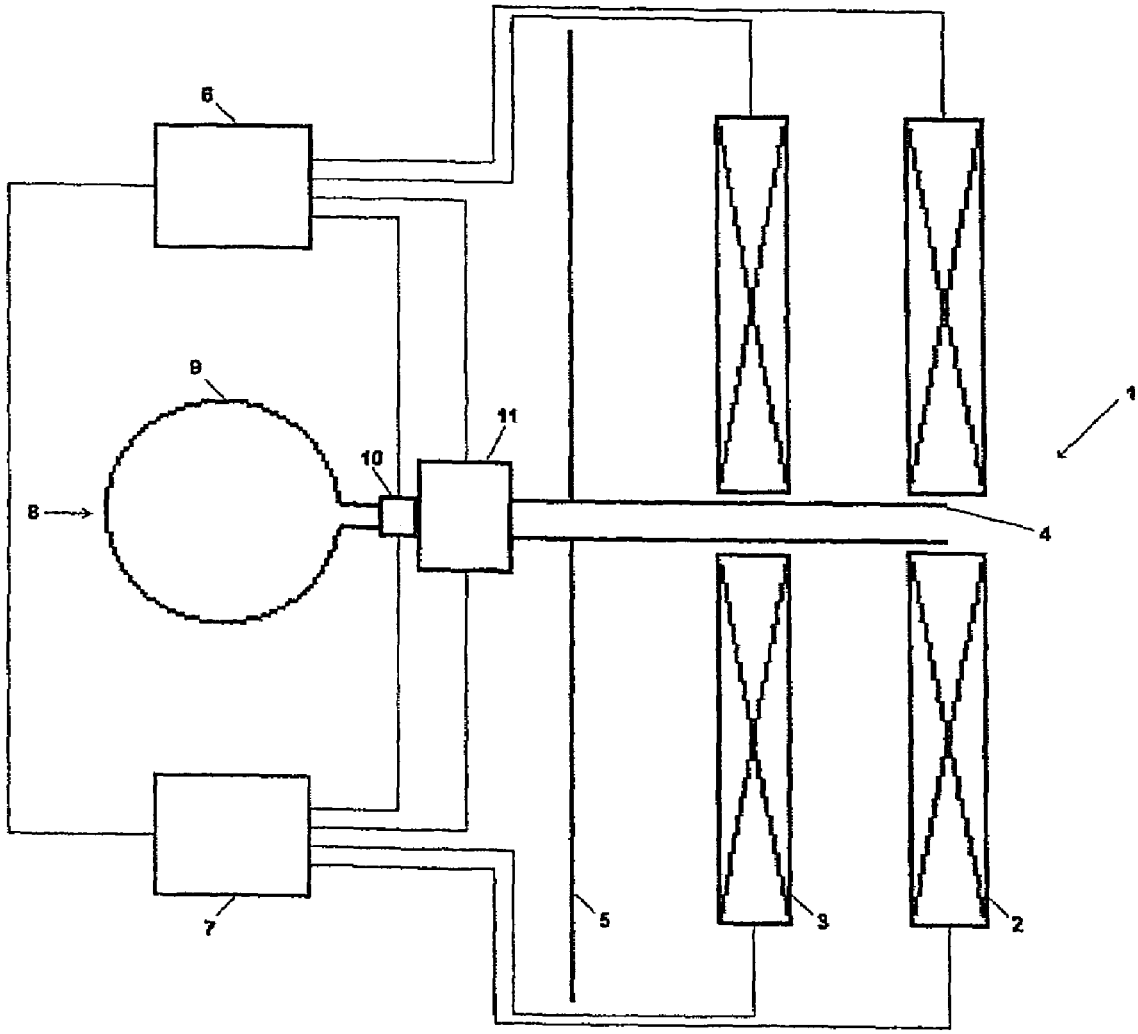
FIG. 4 shows a block diagram of a plasma motor according to the invention.

FIG. 4 shows a block diagram of a plasma motor which is based on the present invention and comprises the already described magnetic nozzle 1, the primary coil 2 and at least one secondary coil 3, which is of the opposite polarity to the primary coil 2, and is supplied with an oscillating electrical signal. A tube 4 is passed through the coils 2, 3 and ends in the area of the primary coil 2. A shielding plate 5 is located at the side, alongside the secondary coil 3, and shields the electronics from the magnetic field caused by the coils 2 and 3. The shielding plate 5 prevents expansion of the magnetic lines of force of the secondary field that is produced by the secondary coil 3 in the opposite direction with respect to the primary coil 2. The device 8 for production of material which can be ionized is formed, in the given example, by a fuel tank 9 and a control valve 10 for supplying an ionization chamber 11 with fuel from the fuel tank 9. The emission mass is passed from the fuel tank 9 via the control valve 10 into the ionization chamber 11. The ionized fuel flows as a plasma through the tube 4 into the magnetic nozzle 1, which is formed by the primary field that is generated by the primary coil 2. The interaction with the secondary field that is generated by the secondary coil 3, which is supplied in an oscillating form, results in the primary field being periodically deformed by the opposite polarity of the secondary field, as a result of which the magnetic nozzle 1 is constricted in a pulsating form by the effect of the Alfvén waves that occur during this process, thus creating an acceleration mechanism. This acceleration mechanism is assisted by the presence of the shielding plate 5, since the secondary field cannot propagate in the opposite direction to the primary coil 2. The illustrated plasma source as the device 8 for production of material which can be ionized represents only one possible alternative. In principle, the system can also contain other devices 8 for production of material which can be ionized. The coils 2, 3, or else other components, are supplied with appropriate electrical power by means of an electrical supply device 6. A control device 7, which is connected not only to the electrical supply device 6 but also to the coils 2, 3 and components of the device 8 for production of material which can be ionized, is used to control the individual components. This control device 7 may be formed by a computer, a microprocessor or a microcontroller.

Figure 5:
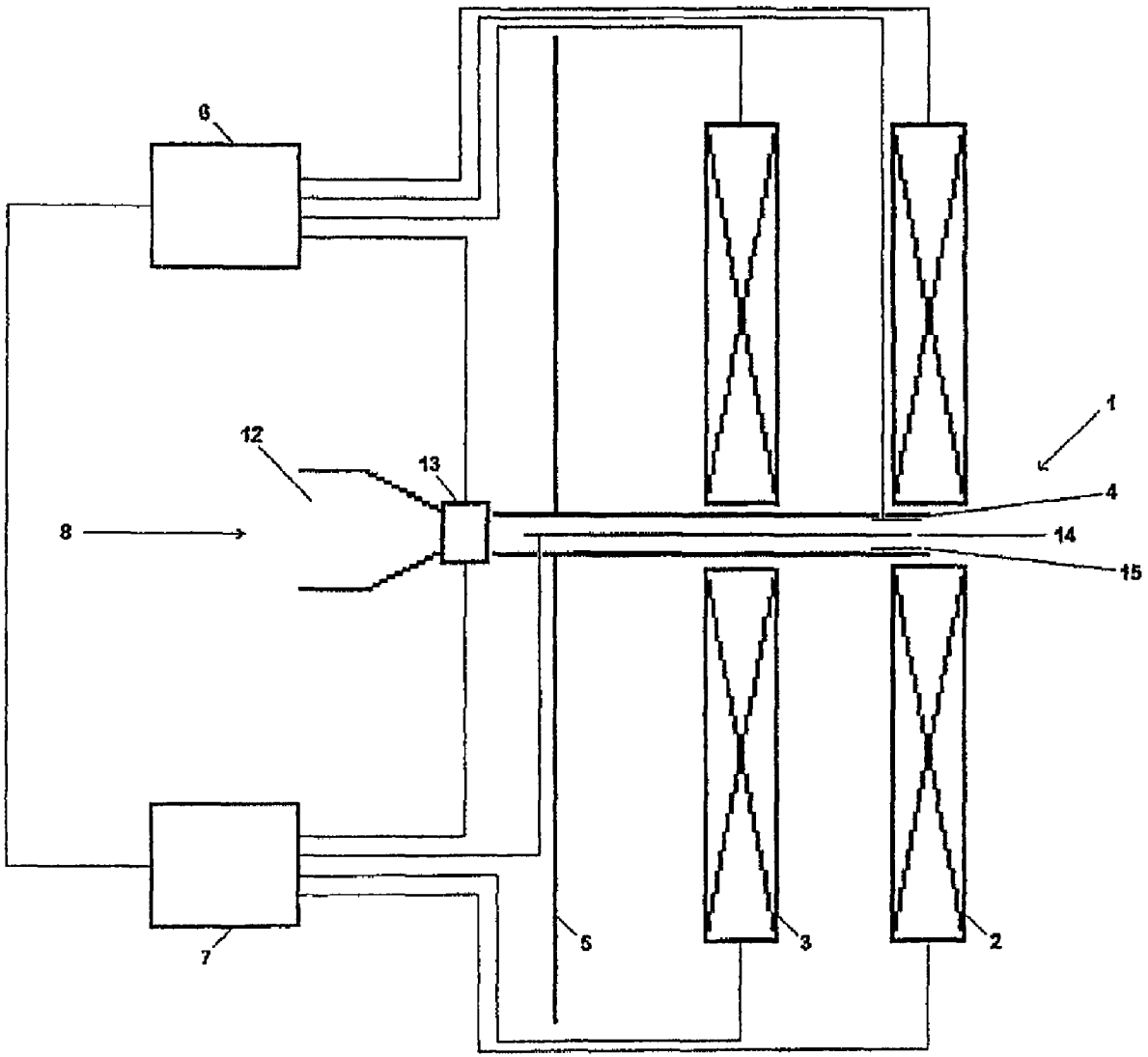
FIG. 5 shows a block diagram of a hydrodynamic propulsion system according to the present invention.

FIG. 5 shows a block diagram of a further embodiment of a device according to the invention for generation of Alfvén waves, in which the device 8 for production of material which can be ionized comprises an inlet channel 12 through which liquid which can be ionized can flow. The throughput mass of the liquid flowing in through the inlet channel 12 is adjusted via a control valve 13 and is passed into the tube 4. An electrode 14 which is polarized as a cathode is located in the centre of the tube 4, and an electrode 15 which is in the form of an anode is located concentrically with respect to this in order to form a discharge path. The electrodes 14, 15 are connected to the electrical supply device 6. The throughput mass flows through the inlet channel 12 via the control valve 13 into the tube 4 in the magnetic nozzle 1. The magnetic nozzle 1 is constricted in a pulsating manner by the effect of the Alfvén waves that are created, thus resulting in an acceleration mechanism. The ion density at the input to the magnetic nozzle 1 can be increased via the discharge path which is formed between the electrodes 14, 15. The individual components can in turn be controlled in a corresponding manner by a control device 7. A magnetohydrodynamic variant such as this may, for example, be used to form a propulsion system for submarines, or a drive for hydrodynamic pumps. In this case as well, a shielding plate is advantageously located alongside the secondary coil 3, shields the electronics from the magnetic field and prevents expansion of the magnetic lines of force in the opposite direction to the primary coil 2. Even if magnetic shielding is not completely ensured by the shielding plate 5, electrical shielding is always provided in this way.

One practical example will be explained, and the determined measured values will be compared with simulated values, with reference to FIGS. 6 to 9.

The most important mathematical principles of numerical simulation relating to the acceleration mechanism of MOA are summarized in a simplified form in the following text.

The phase velocity of an Alfvén wave can be calculated in accordance with the Hannes Alfvén equations either from the charge density or from the mass density of the medium through which the wave passes. In the present case, because of the relationship with the throughput mass of a motor, the variant with mass density is preferred:

$$V_{Alfvén}=c/sqrt(1+((\mu_0\cdot c^2\cdot phi)/B^2)) \quad (1.1)$$

where:

c=speed of light in a vacuum $\mu_0$=magnetic field constant phi=mass density

B=magnetic flux density

In this case, it should be remembered for the mass density phi that the mechanism operates in a pulsed manner. Thus:

$$phi=(M/f)\cdot(1/vol) \quad (1.2)$$

M=mass flow per second f=oscillation frequency of the magnetic field vol=volume of the magnetic nozzle The mass per oscillation clock cycle is thus also a critical factor for the relationship between the mass and the volume.

However, technical factors must also be taken into account if the form of the magnetic field changes. The signal response time and the cut-off frequency of the secondary coil 3 govern the time period which is required for formation of the secondary field. The rate at which the geometry of the primary field changes may be less than the actual Alfvén velocity $v_{Alfvén}$. Since the speed of propagation of the disturbance caused by the secondary coil 3 in the field geometry of the primary field is critical, the time constant tau must also be taken into account, and is given by the relationship:

$$tau=L/R \quad (2.1)$$

where:

L=inductance of the coil

R=resistance

The switching time $t_s$ of the secondary coil 3 is:

$$t_s=tau\cdot 2\cdot Pi \quad (2.2)$$

and the cut-off frequency $f_g$ of the secondary coil 3 is:

$$f_g=1/t_s \quad (2.3)$$

The "technical" Alfvén velocity $v_{Alfvén}$ depends on how quickly the disturbance propagates, governed by the charging time of the secondary coil 2, and is:

$$v_{Alfvén}=\text{distance}/t \quad (2.4)$$

where the distance describes the propagation path of the Alfvén wave as the mean deformation path of the field. If this technical Alfvén velocity is less than the physically possible Alfvén velocity, then $v_{Alfvén(t)}$ is the relevant value.

The Alfvén velocity $v_{Alfvén}$ now defines how quickly the magnetic field can change its geometry. However, it is now critically important that material can also be transported, at least in the high field density area, by means of the Alfvén wave. As has already been mentioned above, the Alfvén limit must be taken into account for this purpose, which is exceeded when the kinetic energy of an interacting particle is greater than the local magnetic field strength. For this purpose, the kinetic particle energy must first of all be determined from the initial temperature. The thermal particle velocity is given by:

$$T\cdot k\cdot(3/2)=(m\cdot v_T^2)/2 \quad (3.1)$$

T=temperature k=Boltzmann constant m=particle mass $v_T$=particle velocity

The kinetic particle energy can now be related to the field strength:

$$\text{Kinetic particle energy}=(m\cdot v_T^2)/2 \quad (4.1)$$

Limit value=energy density of the field $$=(\mu_0 \cdot B^2)/2 \quad 4.2)$$

$\mu_0$=magnetic field constant

B=magnetic flux density

If the kinetic particle energy is less than the limit value, mass transport by means of the Alfvén wave is possible.

In the case of the magnetic nozzle the mechanical wall forces are formed by particles which circulate around the lines of force in the area of high field density. These Lorentz particles transmit the so-called J×B forces to the enclosed volume and scatter the particles which are attempting to leave the enclosed area, such that the material which is located therein can escape only from the nozzle opening. In this case, it should be noted that there must be a minimum density of Lorentz particles along the magnetic nozzle walls for the mechanism to operate effectively. If this condition is not satisfied, then a mass loss occurs during the compression, particularly in the event of incomplete ionization of the emission mass, because the nozzle walls are "leaky". This effect can be described approximately as follows:

$$J=J_0^x \quad (5.1)$$

J=unionized mass of remaining gas which remains in the enclosed volume, $J_0$=original total mass of unionized gas in the enclosed volume, x=loss factor, which includes the ratio between the minimum and the actual ion density, and can also be described as the effective cross section.

J and $J_0$ can in this case be represented as a value of x of 1. These parameters are important only when the ion source or plasma source does not ensure a complete or adequate ion density. Since the actual acceleration mechanism is decoupled from this source, the latter can be optimized, in energy terms, to the production of a minimum ion density. This is a secondary parameter for the mechanism itself, but it must be taken into account if appropriate.

If the magnetic field changes its form, so that the magnetic nozzle becomes narrower, spatial compression of the mass located in it takes place, with the compression rate corresponding to the Alfvén velocity $v_{Alfvén}$. If this is greater than the speed of sound within the emission mass, then the latter is inelastically compressed, which leads to corresponding thermal excitation in the case of an ideally plastic gas body.

The Newton's force equation, as shown below, can be used as the basis for determination of the energy supplied by inelastic compression, as follows:

$$F=M\cdot(v^2/(2\cdot d1)) \quad (6.1)$$

where

F=force

M=mass v=velocity dl=inelastic deformation distance derived as follows:

$$F=M\cdot(v_R^2/(2\cdot Def))=M\cdot(v_R^2/(2\cdot(dl/dl_{elast}))) \quad (6.2)$$

where Def represents the deformation factor for the ratio of the force supplied by means of an impulse to the force which can be transported elastically and results from this. $v_R$ describes the $\Delta_V$, that is to say the velocity change along a reference distance of 1 m.

All of the variables which are related to the original equation can be derived in a corresponding manner from this factor, as follows:

$$Def=F_{ind}/F_{res}=v_{ind}^2/v_{res}^2=I_{ind}/I_{res}=dl/dl_{elast} \quad (6.3)$$

where $dl_{elast}$ represents the elastic component within the overall deformation distance. In the case of fully elastic deformation, Def thus always has the value 1. It is thus clear that a dimensionless factor can be defined from the ratio of the path lengths.

If $I_{ind}$ represents the impulse which is supplied by the Alfvén wave, then $I_{res}$ is that component of this which can be transported elastically by the compressed medium.

$$I_{def}=I_{ind}-I_{res} \quad (6.4)$$

is thus that component of the supplied impulse which is converted to irreversible deformation. In the case of gases and plasmas as ideal plastic bodies without any shear modulus all of this inelastic deformation is converted to heat.

Thus, if the speed of sound in the medium to be compressed and the Alfvén velocity are known, then the impulse distribution factor can be determined from them. Since both the mass per oscillation clock cycle and the mass of a particle are known, the mean impulse change, and thus also the mean particle velocity and the temperature, can be determined from the number of particles and their mass.

The new speed of sound in the plasma is thus obtained from the new temperature:

$$v_c=v_t\cdot sqrt(1+(T_e/T_i)) \quad (7.1)$$

where $v_c$=ion speed of sound $v_t$=mean particle velocity of the ions $T_i$=ion temperature $T_e$=electron temperature In the simplified model, the ion temperature and the electron temperature are assumed to be the same. In practice, the electrons are at a higher temperature than the ions, so that unification of the temperatures can be regarded as "worst-case" assumption. Although the distribution of the impulses in the plasma depends on the mass of the particles and the electron gas therefore does not make up a significant proportion of the overall impulse, it can be assumed as a further worst-case condition that the electrons make up a greater proportion than they actually should on the basis of their mass. The impulse component of the photons in the plasma can thus also be included. By calculation, the ions are in this case given a smaller impulse per particle, which reduces the resultant ion speed of sound. On the basis of the assumption that a gaseous body in a vacuum expands at its own speed of sound, we thus obtain from this the mean outlet flow velocity from the magnetic nozzle. Since the plasma expands during the compression phase itself at its own rising speed of sound, we in this case obtain a considerable proportion of the total thrust power just from this.

This results in initial and final values for the compression phase by the Alfvén wave during one clock cycle. Since the impulse can be described as:

$$M\cdot v=F\cdot t \quad (8.1)$$

it is possible to integrate over t as the propagation time of the wave.

The compression phase is resolved into time steps, thus resulting in profiles of the temperature and speed of sound. In this case, the same principles are used as in the described overall calculation. The mean temperature, the outlet flow velocity and the thrust during the compression phase are then determined from the profile date. The expansion phase which follows the compression is likewise assumed to be adiabatic. In this case, however, and in contrast to the compression phase, no impulse externally supplied by the Alfvén wave need be resolved, for which reason this can be calculated from the volume change during the expansion time.

$$T=T_a\cdot((V_a/V)^{ad} \tag{9.1}$$

where:

T=temperature after expansion $T_a$=initial temperature $V_a$=initial volume

V=final volume ad=adiabatic exponent

In this case as well, the volume change is integrated in time steps, from which the corresponding mean values are then determined from the profiles.

For the time distribution, it should be noted in this case that an oscillation clock cycle is divided in accordance with the phase geometry of a control signal into a off phase and a switching phase, and an asymmetric duty cycle with a shorter off phase has been found to be advantageous in this case. During the off phase, that is to say the initial situation, in which the secondary coil 3 is not polarized in the opposite direction to the primary coil 2, does not result in the primary field being deformed by the secondary field, and plasma flows from the source into the magnetic nozzle. The switching phase is divided into a compression phase and an expansion phase. During the compression phase, the magnetic nozzle is deformed by the secondary field and the plasma is heated by inelastic compression, as a result of which it expands in an accelerated manner during this process. During the expansion phase, the magnetic nozzle remains deformed by the secondary field, and the heated plasma expands during the expansion, and is cooled down in the process.

The peak values which occur during this process are greater than the mean values calculated over the time periods. In this case, the off phase must also be taken into account in the mean values during one entire oscillation clock cycle.

The values for thrust and outlet flow velocity are then calculated for the time unit of one second.

Examples Relating to Simulation

Two calculation examples are compared below. The first column shows a number of values for a configuration in the low power area, which has already been tested experimentally with a prototype (see below). The second column shows the corresponding values for a configuration in the planned high-power area. In the first case, nitrogen is assumed to be the working gas. Argon is assumed to be the working gas in the high-power variant.

| | 1st Example | 2nd Example | |
|---|---|---|---|
| Working gas | $N_2$ | Ar | |
| Volume of magnetic nozzle | $3.142 \cdot 10^{-5}$ | $3.142 \cdot 10^{-5}$ | $m^3$ |
| Mass/second | $1.0 \cdot 10^{-6}$ | $1.0 \cdot 10^{-7}$ | kg |
| Frequency | $1.0 \cdot 10^{-2}$ | $1.0 \cdot 10^{7}$ | Hz |
| Field strength | $5.0 \cdot 10^{-2}$ | $6.5 \cdot 10^{-3}$ | T |
| Initial temperature of the throughput mass | $1.0 \cdot 10^{2}$ | $3.2 \cdot 10^{4}$ | K |
| Ion mass m | $2.335867551 \cdot 10^{-26}$ | $5.977908 \cdot 10^{-26}$ | kg |
| Mean propagation distance of the Alfvén wave, depending on the field geometry | $1.5 \cdot 10^{-2}$ | $1.5 \cdot 10^{-2}$ | m |
| corresponding to 1.2: | | | |
| Mass/frequency | $1.0 \cdot 10^{-8}$ | $1.0 \cdot 10^{-13}$ | kg |
| Mass density phi | $3.1826 \cdot 10^{-4}$ | $3.1826 \cdot 10^{-9}$ | $kg/m^3$ |
| from 1.1.: | | | |
| $v_{Alfvén}$ | $2.4998014 \cdot 10^{3}$ | $1.02765843 \cdot 10^{5}$ | m/s |
| From the cut-off frequency, which is dependent on the characteristics of the coil, 2.4 results in: | | | |
| $v_{alfvén(t)}$ | $1.79049306 \cdot 10^{3}$ | $1.02765843 \cdot 10^{5}$ | m/s |
| for a speed of sound in the initial situation of | $5.95518008\ 10^{2}$ | $6.65915895\ 10^{3}$ | m/s |
| $v_c$ | | | |
| 6.3 results in a compressibility factor of | $9.03973057 \cdot 10^{0}$ | $2.38154512 \cdot 10^{2}$ | |
| Def | | | |
| and an overall impulse of | $2.09422856 \cdot 10^{-8}$ | $1.5 \cdot 10^{-9}$ | kg · m/s |
| supplied during propagation time of the Alfvén wave of | $8.37758064 \cdot 10^{-6}$ | $4.6157 \cdot 10^{-8}$ | s |
| results, according to 6.4, in a thermal impulse of: | $1.8625592 \cdot 10^{-8}$ | $1.4993 \cdot 10^{-9}$ | kg · m/s |
| which leads to a mean thermal particle velocity of | $4.23116478 \cdot 10^{2}$ | $1.5316 \cdot 10^{5}$ | m/s |
| $v_T$ | | | |
| and thus, according to 7.1, in an ion speed of sound of: | $5.98377061 \cdot 10^{2}$ | $2.1660 \cdot 10^{5}$ | m/s |
| $v_c$ | | | |
| The integral between the initial value and final value of the speeds of sound results in a mean value during the compression phase of | $5.96947535 \cdot 10^{2}$ | $1.1163 \cdot 10^{5}$ | m/s |
| From the expansion phase, 9.1 results in a final value of | $3.71829384 \cdot 10^{1}$ | $1.2964 \cdot 10^{5}$ | m/s |
| and an integrated mean value of: | $1.04113686 \cdot 10^{2}$ | $1.6229 \cdot 10^{5}$ | m/s |
| Overall, this results in a mean expansion velocity of: | $3.50228722 \cdot 10^{2}$ | $1.3144 \cdot 10^{5}$ | m/s |
| If the ion component is: | 1.0 | 100.0 | % |
| and the throughput mass per oscillation clock cycle is M | $1.0 \cdot 10^{-8}$ | $1.0 \cdot 10^{-14}$ | kg |
| we obtain an unionized mass of remaining gas per oscillation clock cycle of: | $9.9 \cdot 10^{-9}$ | $0.0 \cdot 100$ | kg |

-continued

| | 1st Example | 2nd Example | |
|---|---|---|---|
| and, according to 5.1 an emission mass that is relevant for the thrust of | $9.912181891 \cdot 10^{-9}$ | $1.0 \cdot 10^{-14}$ | kg |
| per oscillation clock cycle including the ion component, which results in an emission mass that is relevant for the thrust per second of | $9.912181891 \cdot 10^{-7}$ | $1.0 \cdot 10^{-07}$ | kg |
| This results in a mean thrust during the compression of: | $5.4452 \cdot 10^{-4}$ | $1.1163 \cdot 10^{-2}$ | N |
| during the expansion phase of | $9.49706 \cdot 10^{-5}$ | $1.6229 \cdot 10^{-2}$ | N |
| together over the switching phase | $9.572385 \cdot 10^{-5}$ | $1.3799 \cdot 10^{-2}$ | N |
| and permanently of: | $4.78619269 \cdot 10^{-5}$ | $1.31448 \cdot 10^{-2}$ | N |
| The time components of an oscillation clock cycle are composed of: | | | |
| Time per: | | | |
| Oscillation clock cycle | $1.0 \cdot 10^{-2}$ | $1.0 \cdot 10^{-7}$ | s |
| Zero phase | $5.0 \cdot 10^{-3}$ | $5.0 \cdot 10^{-9}$ | s |
| Switching phase | $5.0 \cdot 10^{-3}$ | $9.5 \cdot 10^{-8}$ | s |
| With the switching phase being divided into: | | | |
| Compression time | $8.37758064 \cdot 10^{-6}$ | $4.61575 \cdot 10^{-8}$ | s |
| Expansion time | $4.99162242\ 10^{-3}$ | $4.88424\ 10^{-8}$ | s |

A symmetrical duty cycle is used in the first example, corresponding to the experimental conditions, while an asymmetric phase geometry is used for calculation in the second example.

Because of the stated worst-case conditions, the values listed in the first column are less than those actually measured. The permanent thrust was in this case measured to be 1.4 mN. In this case, it should be noted that boot-strap effects, such as the component of the cold-gas thrust and the effect of the ion source, have not been included in the calculation. However, these effects were insignificant in the measurement since the ion source was operated, for example, with an input power of 1 W, so that this made no significant contribution to the increase in the ion temperature.

Various reference ion densities are assumed in the simulation, and with various mass flows, related to a low ionization rate of 1%. The mass losses which occur during this process as a result of incoherent expansion are mainly responsible for the resonance area which was observed during the measurement and indicates a thrust minimum in the operating area around 400 Hz.

The reference ion densities are values extrapolated from the data from other MPD systems and define the ion density which is the minimum required in order to comply with the condition defined from the second limit value. If the ion source or plasma source is sufficiently powerful as a secondary system in order to ensure the corresponding minimum ion density, there is therefore no need with the present system to achieve complete ionization just by means of a secondary system such as this. Since, in contrast to competitive systems, the actual acceleration mechanism operates independently of the ion source or plasma source, the required amount of energy for the latter can also be optimized with respect to a minimum in other power areas. The improvement in the efficiency that results from this has a positive effect from then on on the overall system.

Fundamentally, it is evident that there is a good match between the theoretical predictions and the practical results. Since the simulation is carried out with worst-case conditions and the experimental measurements are actually quantitatively higher, while the qualitative profile matches, it can be expected that the predicted results can also at least be achieved in the higher power area.

Figure 6:
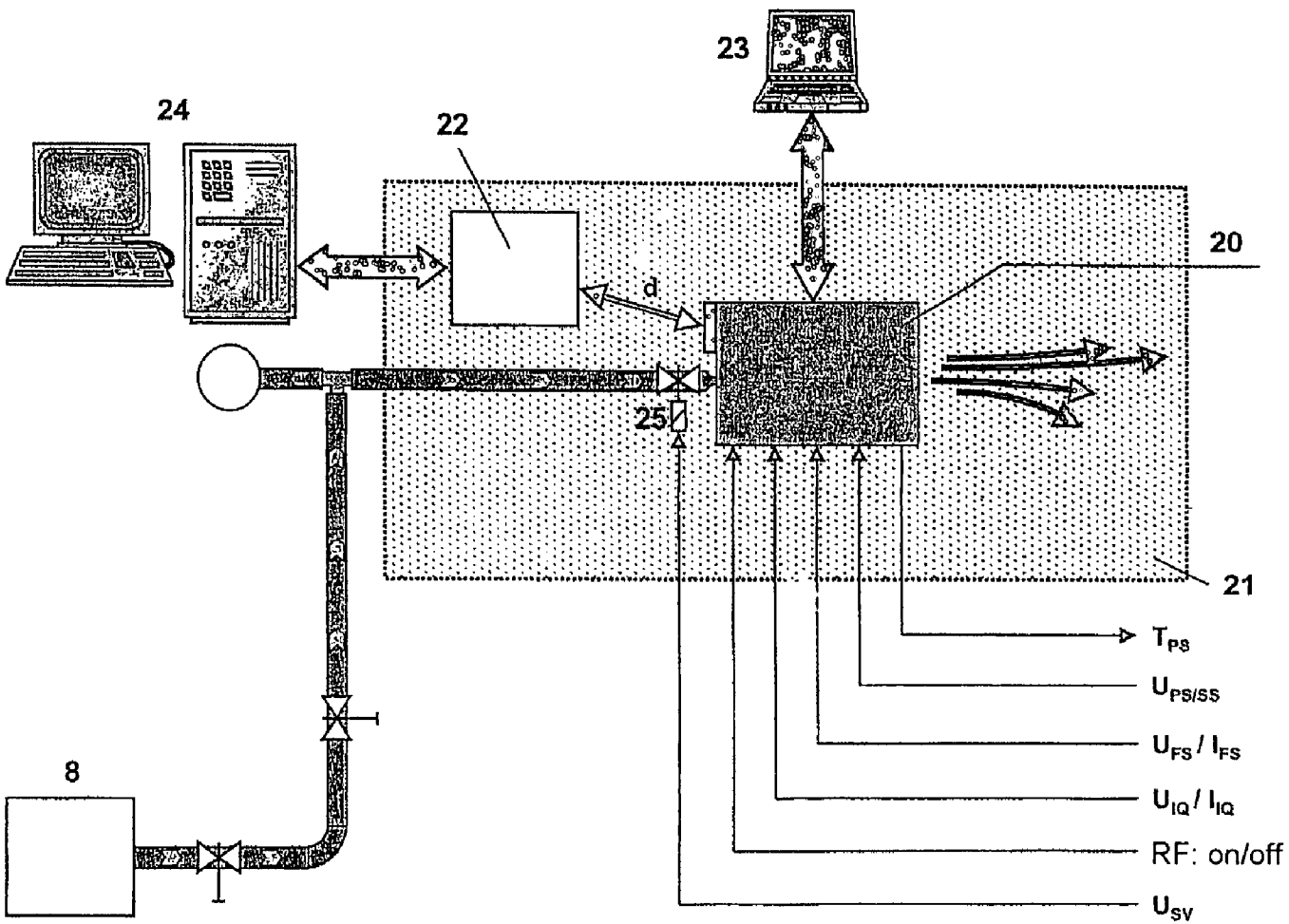
FIG. 6 shows a block diagram of a practical experimental layout for testing the operation of the method according to the invention.

FIG. 6 shows a block diagram of the test layout in which a prototype of the device according to the invention was used in practice to generate Alfvén waves. The device 20 for generation of Alfvén waves according to the present invention was placed by means of a suspension system in a vacuum chamber 21, and was connected to a device 8 for production of material which could be ionized, in the present case a nitrogen cylinder, via lines with valves, which will not be explained in any more detail. This was done using the vacuum chamber at the Faculty for Spaceflight Technology at the Munich Technical University in Garching. The distance d to the device 20 for generation of the Alfvén waves was determined using a laser reflection meter 22. Appropriate computer facilities 23, 24 monitored and controlled the components of the test layout.

Figure 9C:
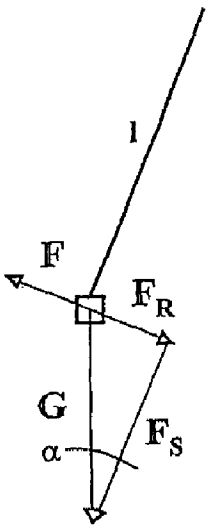
FIGS. 9*a* to 9*c* show schematic circuit diagrams in order to explain the calculation of the deflection of the device in order to generate Alfvén waves in the test shown in FIG. 6.
Figure 9A:
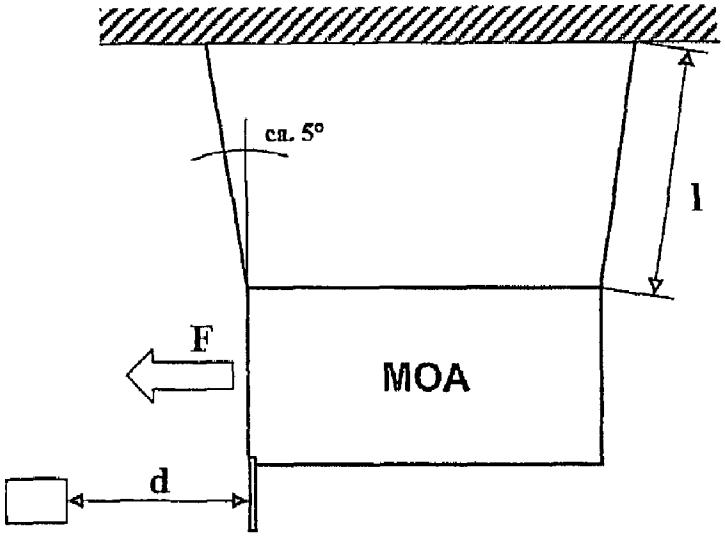
Figure 9B:
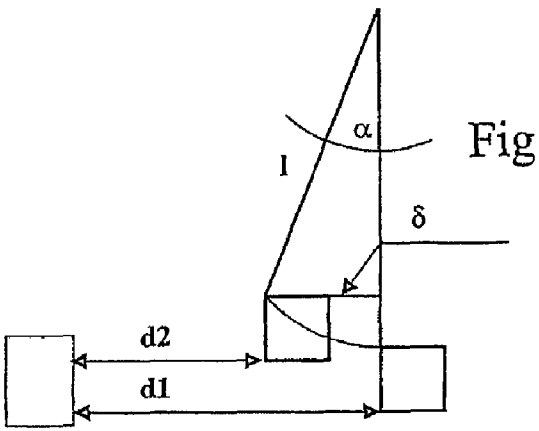

FIGS. 9*a* to 9*c* show schematic circuit diagrams of the suspension system for the device 20 for generation of the Alfvén waves in the vacuum chamber 21, and the determination of the force over the distance d determined by the laser reflection meter 22. The equation $$\sin \alpha = \delta / l$$

can be derived from FIG. 9*b*. Using the sketch shown in FIG. 9*c*, relating to the force relationships, it follows that:

$$F = -F_R$$

$$G = m \cdot g = F_R + F_S$$

$$\sin \alpha = -F/G$$

$$F = -m \cdot g \cdot \sin \alpha$$

Finally, the resultant force F is obtained from:

$$F = -m \cdot g \cdot \delta / l.$$

The measurement procedure was characterized by the following steps:

1. Start up the vacuum chamber
2. Determine the distance d (zero indication)
3. Switch on the gas supply
4. Set the operating pressure
5. Open the switching valve 25
6. Check the pressure within the vacuum chamber
7. Determine the distance d
8. Start up the ion source
9. Determine the distance d
10. Start up the primary coil (with a time limit)

10.1 Set the primary coil time limit (because of excessive temperature)

10.2 Set the primary coil voltage
11. Determine the distance d
12. Start up the secondary coil
13. Determine the distance d
14. Monitor the primary coil temperature
15. Switch off the primary coil and secondary coil and allow them to cool down
16. Determine the distance d
17. Switch off the ion source
18. Determine the distance d
19. Switch off the gas supply
20. Determine the distance d Of the 4 tests carried out so far, the experiment carried out on 28 May 2004 provided the final evidence that the mechanism works. Further secondary parameters were introduced into the numerical simulation on the basis of the evaluation. These parameters relate primarily to the existing test situation. The cut-off frequency of the secondary coil 2 and the thrust profile at a low ionization rate may be quoted as examples.

Three different plasma sources were constructed for the prototypes of the device 20 for generation of Alfvén waves, and two of these have been tested so far. It has thus also been possible to demonstrate that the actual acceleration mechanism can be assessed independently of the ion source or plasma source.

Figure 7:
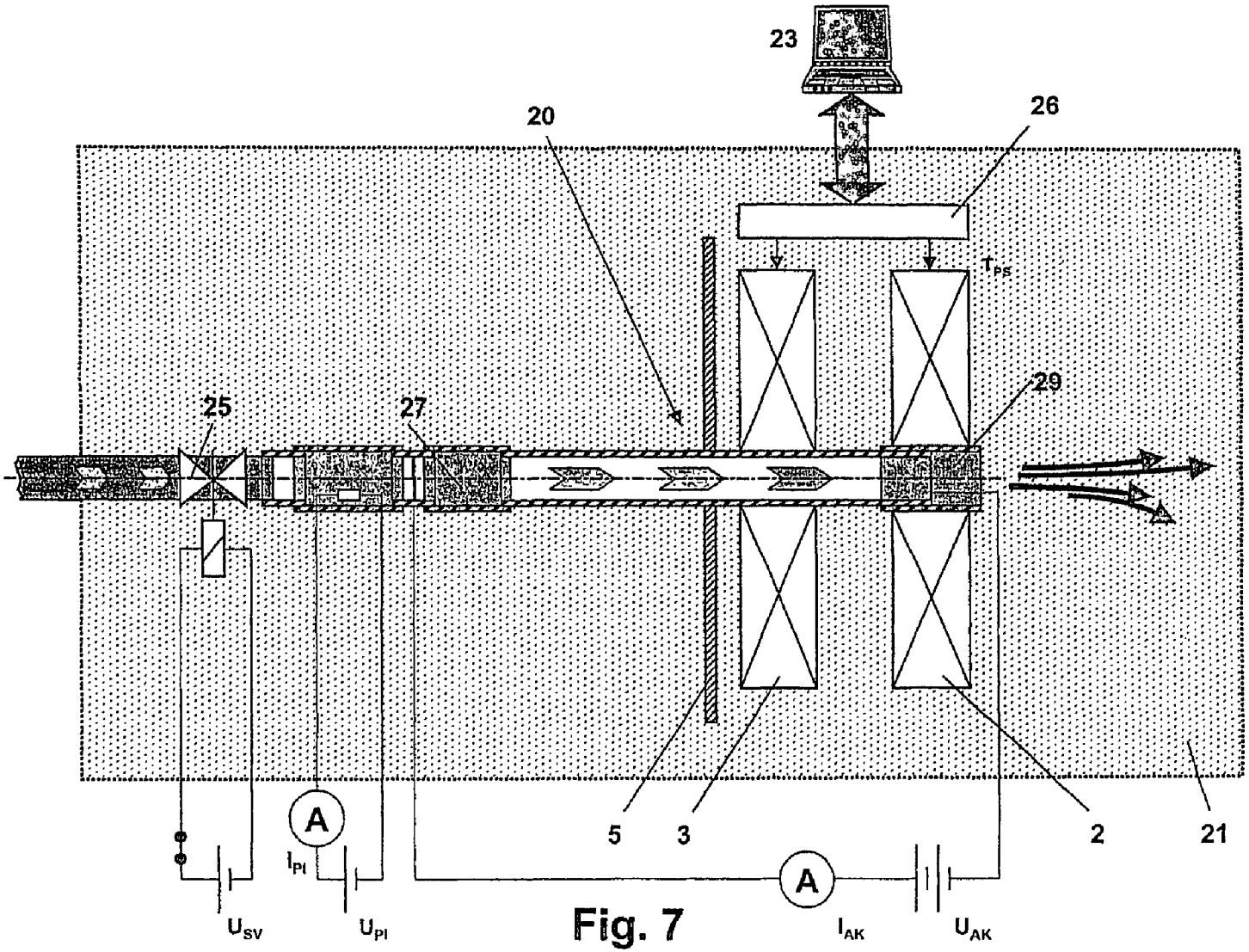
FIG. 7 shows a block diagram of a device for generation of Alfvén waves.

FIG. 7 shows a device 20 for generation of Alfvén waves using a high-voltage discharge path as the ion source, with nitrogen $N_2$ being supplied via a supply line and the switching valve 25 to the anode 27, and high voltage being applied between the anode 27 and the cathode 29, as a result of which the nitrogen $N_2$ flowing through is ionized by surges of electrons in the discharge area. Control electronics 26, which are connected to a computer unit 23, are used to drive the primary coil 2 and the secondary coil 3.

Figure 8:
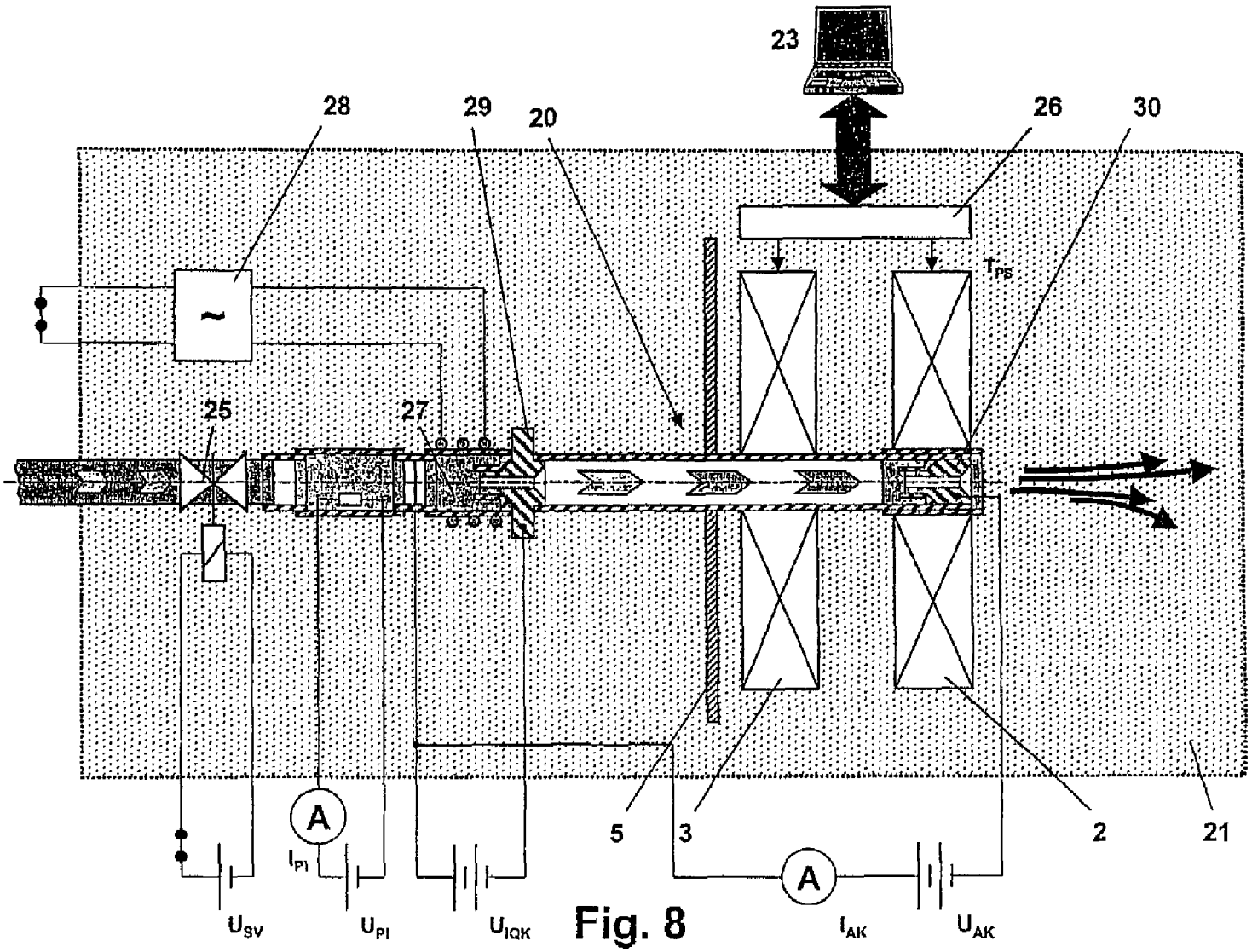
FIG. 8 shows a block diagram of a further device for generation of Alfvén waves.

FIG. 8 shows a variant of the device 20 for generation of Alfvén waves with a radio-frequency ion source, in which case the corresponding radio-frequency energy that is required to generate the material which can be ionized is supplied via a radio-frequency generator 28 between the anode 27 and the cathode 29. In accordance with the induction law, a radio-frequency electrical vortex field is induced, which accelerates the discharge electrons towards the acceleration cathode 30 until they can ionize the nitrogen $N^2$.

The prototype is designed for a low power range. The aim was to achieve a proof-of-principle and to obtain fundamental data for further technical optimizations.

The appliance does not have an active cooling system and was always operated for up to a maximum of 1 minute. The cooling was carried out cumulatively, so that it was necessary to take account of thermal regeneration intervals between the individual operating times.

In the practical investigations, the secondary coil 3 was driven with a square-wave current signal, with the oscillation frequency being 100 Hz. The flanks of the square-wave signal were flattened. The length of the suspension devices for the device 20 in the vacuum chamber 21 was 0.44 m, and the mass of the device 20 was 6 kg. The pressure in the vacuum chamber 21 was $3.1\times10^{-3}$ mbar. The operating pressure of the nitrogen $N_2$ was 5 mbar. Discrepancies which corresponded to a force of 1.07 mN could be determined with the aid of the reflection meter 22.

The most important characteristic values, determined by simulation, of a propulsion system according to the invention are shown in the following table in order to illustrate the potential of the device according to the invention for a propulsion system and for direction corrections for spacecraft. In this case, various media, such as argon, carbon dioxide, hydrogen, neon and xenon were used, with various mass flows M through the fuel system and various oscillation frequencies $f_{oscil}$, and the simulation covered the Alfvén velocity $v_{Alfvén}$, the mean outlet flow velocity $V_0$ of the fuel mass, the thrust, the overall achieved efficiency $\eta$, the power $P_{jet}$ which is introduced into the exhaust jet for acceleration of the material, and the total power P introduced.

| M g/s | $f_{oscil}$ MHz | $V_{Alfvén}$ km/s | $V_0$ km/s | Thrust mN | $\eta$ % | $P_{jet}$ kW | P kW |
|---|---|---|---|---|---|---|---|
| | | | Argon (Ar) | | | | |
| 0.0001 | 10 | 324.97 | 131.13 | 13.11 | 7.70 | 0.86 | 11.16 |
| 0.0100 | 10 | 32.50 | 26.11 | 261.12 | 52.73 | 3.41 | 6.46 |
| 0.0040 | 1 | 16.25 | 15.18 | 60.70 | 62.67 | 0.46 | 0.74 |
| | | | Carbon dioxide ($CO_2$) | | | | |
| 0.0001 | 10 | 324.97 | 129.54 | 12.95 | 7.52 | 0.84 | 11.16 |
| 0.0100 | 10 | 32.50 | 24.56 | 245.61 | 48.34 | 3.02 | 6.24 |
| 0.0040 | 1 | 16.25 | 14.07 | 56.26 | 61.34 | 0.40 | 0.65 |
| | | | Hydrogen ($H_2$) | | | | |
| 0.0001 | 10 | 324.97 | 147.66 | 14.77 | 9.70 | 1.09 | 11.23 |
| 0.0100 | 10 | 32.50 | 33.21 | 332.10 | 39.56 | 5.51 | 13.94 |
| 0.0007 | 6 | 95.14 | 82.99 | 58.10 | 63.11 | 2.41 | 3.82 |
| | | | Neon ($N_2$) | | | | |
| 0.0001 | 10 | 324.97 | 131.45 | 13.14 | 7.74 | 0.86 | 11.16 |
| 0.0100 | 10 | 32.50 | 26.41 | 264.09 | 53.48 | 3.49 | 6.52 |
| 0.0040 | 1 | 16.25 | 15.36 | 61.46 | 62.35 | 0.47 | 0.76 |
| | | | Xenon (Xe) | | | | |
| 0.0001 | 10 | 324.97 | 128.67 | 12.87 | 7.42 | 0.83 | 11.16 |
| 0.0100 | 10 | 32.50 | 23.65 | 236.48 | 45.46 | 2.80 | 6.15 |
| 0.0040 | 1 | 16.25 | 13.33 | 53.31 | 58.32 | 0.36 | 0.61 |

The results show different efficiencies, depending on the mass flow M used and the oscillation frequency $f_{oscil}$. An optimum setting can thus be achieved depending on the application. For example when the power P is particularly low, as is the case by way of example with satellites, attitude correction is carried out with as high an efficiency as possible. The present invention makes it possible to save an enormous amount of fuel and thus to make better use of the maximum load of a spacecraft. Electric motors as are used in spaceflight are characterized by high outlet flow velocities, but have the disadvantage of low thrust densities. Plasma motors admittedly make it possible to achieve higher thrust densities, but the outlet flow velocities are lower. For example, the outlet flow velocities $v_0$ of known plasma motors are in the range from 30-50 km/s, and those of electric motors are up to 80 km/s. Normal values for the thrust of plasma motors are 250-300 mN, while those of electric motors are less than 50 mN. A propulsion system which operates on the basis of the present method makes it possible to combine the advantages of a high outlet flow velocity of electric motors with higher thrust densities of plasma motors by suitable choice of the mass flow of the fuel and the operating frequency, in one appliance.

The invention claimed is:

1. A method for the generation of Alfvén waves, in which material which can be ionized is produced and passes through a magnetic field, characterized in that the magnetic field comprises a magnetic primary field which is deformed periodically by at least one oscillating magnetic secondary field of the opposite polarity to the primary field, as a result of which Alfvén waves are formed in the material which can be ionized and is located in this magnetic field, which Alfvén waves propagate at a velocity ($v_A$) which depends on the mass density of the material passing through the magnetic field and on the field strength of the magnetic field, with the field strength of the magnetic field being greater than the kinetic energy of the material which is located in the magnetic field, so that mass is transported by the Alfvén waves.

2. The method as claimed in claim 1, characterized in that the Alfvén velocity ($v_A$) is less than or equal to the speed of sound of the material which is located in the magnetic field.

3. The method as claimed in claim 1, characterized in that the Alfvén velocity ($v_A$) is greater than the speed of sound of the material which is located in the magnetic field.

4. The method as claimed in claim 1, characterized in that the magnetic primary field is essentially constant.

5. The method as claimed in claim 1, characterized in that the magnetic primary field is switched off periodically.

6. The method as claimed in claim 5, characterized in that the oscillating magnetic secondary field is likewise switched off during the periods in which the primary field is switched off.

7. The method as claimed in claim 1, characterized in that the magnetic field is focused in the axial and/or radial direction.

8. The method as claimed in claim 1, characterized in that the field strength of the magnetic primary field is varied while the magnetic secondary field is switched on.

9. The method as claimed in claim 1, characterized in that the Alfvén waves are phase-delayed.

10. The method as claimed in claim 1, characterized in that the Alfvén waves generate a thrust on the basis of the reaction principle.

11. The method as claimed in claim 1, characterized in that the Alfvén waves generate a particle beam of high kinetic energy.

12. The method as claimed in claim 1, characterized in that the Alfvén waves supply additional impulses to an accelerated mass.

13. The method as claimed in claim 1, characterized in that phonons are generated or amplified in the material which is located in the magnetic field.

14. The method as claimed in claim 1, characterized in that phonons are generated or amplified in a surrounding medium by means of the material which is located in the magnetic field.

15. The method as claimed in claim 1, characterized in that the material which is located in the magnetic field is compressed and thermally excited, and in that the thermal excitation of the material generates or amplifies electromagnetic radiation.

16. A device for the generation of Alfvén waves, having a device for production of material which can be ionized, having a magnetic nozzle, which is formed from at least one device for generation of a magnetic primary field and at least one secondary coil for generation of a magnetic secondary field, and a channel for guiding the material which can be ionized through the magnetic fields, and electrical supply devices, characterized in that the at least one secondary coil is of the opposite polarity to the device for generation of the primary field, and is supplied with an oscillating electrical signal, as a result of which the magnetic primary field is deformed periodically by the magnetic secondary field, and Alfvén waves are formed in the material which can be ionized and is located in this magnetic field, which Alfvén waves propagate at the Alfvén velocity ($v_A$), with the field strength of the magnetic field being greater than the kinetic energy of the material which is located in the magnetic field, so that mass is transported by the Alfvén waves.

17. The device as claimed in claim 16, characterized in that the device for generation of the magnetic primary field is formed by a primary coil.

18. The device as claimed in claim 16, characterized in that the device for generation of the magnetic primary field is formed by permanent magnets.

19. The device as claimed in claim 16, characterized in that the coils are designed to be liquid-cooled.

20. The device as claimed in claim 16, characterized in that the coils are designed to be superconductive.

21. The device as claimed in claim 16, characterized in that the device for production of material which can be ionized is formed by a container with gas which can be ionized and by an injector device for introduction of the gas which can be ionized into the magnetic field.

22. The device as claimed in claim 16, characterized in that the device for production of material which can be ionized is formed by a source for supplying electrically conductive liquid.

23. The device as claimed in claim 16, characterized in that a device is provided for phase delaying of the Alfvén waves which are generated.

24. The device as claimed in claim 16, characterized in that a device is provided for focusing of the magnetic field.

25. The device as claimed in claim 24, characterized in that the focusing device is formed by the primary coil and, if appropriate, secondary coil with a magnetic core composed of various materials, for example based on an FFAG (Fixed Field Alternating Gradient) core.

26. The device as claimed in claim 16, characterized in that a magnetic shield is provided.

27. The device as claimed in claim 26, characterized in that the magnetic shield contains a shielding plate, which is arranged on the opposite side of the magnetic field to the outlet direction of the Alfvén waves.

28. The device as claimed in claim 16, characterized in that a control device is provided and is connected to the electrical supply devices for the coils.

29. The device as claimed in claim 28, characterized in that the control device is formed by a computer.

30. A motor for a vehicle, characterized in that a device as claimed in claim 16 is provided.

31. The motor as claimed in claim 30, characterized in that the device for production of material which can be ionized is formed by means of a plasma generator, and thrust is generated with the aid of the Alfvén waves on the basis of the reaction principle.

32. The motor as claimed in claim 30, characterized in that the device for production of material which can be ionized is formed by a device for supplying electrically conductive liquid.

33. The motor as claimed in claim 30, characterized in that the device for production of material which can be ionized is formed by an arc motor.

* * * * *